US005725368A

United States Patent [19]

Arensmeier

[11] Patent Number: 5,725,368

[45] Date of Patent: Mar. 10, 1998

[54] SYSTEM FOR PROVIDING RAPID WARM-UP OF ELECTRICAL RESISTANCE IGNITER

[75] Inventor: Jeffrey N. Arensmeier, St. Louis, Mo.

[73] Assignee: Emerson Electric Co., St. Louis, Mo.

[21] Appl. No.: 801,000

[22] Filed: Feb. 20, 1997

[51] Int. Cl.[6] ..... F23N 5/00

[52] U.S. Cl. ..... 431/66; 219/497

[58] Field of Search ..... 431/66; 219/262, 219/263, 264, 497

[56] References Cited

U.S. PATENT DOCUMENTS 4,130,853 12/1978 Baker ..... 219/497
4,399,781 8/1983 Tsukasaki ..... 219/497
4,402,663 9/1983 Romanelli et al. ..... 431/66
4,444,551 4/1984 Mueller et al. ..... 431/25
4,518,345 5/1985 Mueller et al. ..... 431/24
4,858,576 8/1989 Jeffries et al. ..... 219/497
4,925,386 5/1990 Donnelly et al. ..... 431/28

*Primary Examiner*—Carroll B. Dority
*Attorney, Agent, or Firm*—Paul A. Becker, Sr.

[57] ABSTRACT

A system for enabling an electrical resistance igniter to attain ignition temperature within a few seconds and without exceeding a temperature which could damage the igniter. The system controls the level of power to the igniter based on the determined value of voltage available to energize the igniter and on the determined value of the igniter resistance.

8 Claims, 4 Drawing Sheets

SYSTEM FOR PROVIDING RAPID WARM-UP OF ELECTRICAL RESISTANCE IGNITER

BACKGROUND OF THE INVENTION

This invention relates to systems for controlling energizing of electrical resistance igniters.

In recent years, the standing pilot in many gas fired devices has been replaced by either hot surface ignition or spark ignition. While both types of ignition are widely used, spark ignition has been the ignition source used in those applications requiring ignition within a few seconds. Such applications include, for example, small wall-hung boilers which provide "instantaneous" hot water.

While spark ignition provides rapid ignition, it has a disadvantage of generating electrical and acoustical noise. In applications which use a microcomputer, such electrical noise is undesirable since the noise can adversely affect operation of the microcomputer; in applications such as wall-hung boilers, such acoustical noise is undesirable since the boilers are typically located in occupied areas of the dwelling. Hot surface ignition, which comprises an electrical resistance igniter, does not generate such electrical or acoustical noise. However, it has a disadvantage of requiring more time for the igniter to warm up to a temperature sufficient to ignite gas than it does for spark ignition to provide the sparks which ignite the gas. Therefore, while it may be desirable to use hot surface ignition instead of spark ignition because hot surface ignition does not generate electrical or acoustical noise, it may be undesirable to use hot surface ignition instead of spark ignition unless the warm-up time can be shortened to a few seconds.

An igniter known in the art which is capable of warming up rapidly is a silicon nitride igniter, an igniter constructed of a tungsten heater element embedded in a silicon nitride insulating material. While such an igniter is a desirable igniter because of its fast warm-up time, it has a critical temperature limitation which must be adhered to.

Specifically, in the silicon nitride igniter, the igniter temperature must remain below approximately 1300° C. If the igniter temperature repeatedly approaches 1300° C., the igniter will eventually fail, such failure generally consisting of opening of the tungsten heater element. Since a temperature of approximately 1100° C. is required to reliably ignite gas, the temperature span between the lowest temperature which the igniter must attain to effect ignition and the highest temperature which the igniter can withstand is quite narrow.

U.S. Pat. No. 4,925,386, assigned to the assignee of the present invention, discloses a system for controlling energizing of a silicon nitride igniter wherein the igniter is rapidly heated to ignition temperature. To ensure that the igniter is energized to a temperature sufficiently high to reliably ignite the gas but well below a temperature which could damage the igniter, the system includes a learning routine.

In accordance with the learning routine, the igniter is energized in a first burner cycle to a temperature below 1300° C. but well above the minimum ignition temperature. Energizing of the igniter is reduced in each subsequent burner cycle until the igniter fails to ignite the gas. After the unsuccessful ignition attempt, energizing of the igniter is increased sufficiently to again enable the igniter to effect ignition so that the igniter is then at or slightly above the lowest possible ignition temperature. After a predetermined number of burner cycles with the igniter at or slightly above such lowest possible ignition temperature, the learning routine is repeated. The learning routine thus ensures that the igniter temperature will always be below a temperature which could damage the igniter.

While a periodically occurring unsuccessful ignition attempt, inherent in such a learning routine, is generally acceptable in most applications, it is undesirable in others. For example, in small wall-hung boilers which provide, on demand, hot water for personal washing, it is undesirable to have a failed ignition attempt. Specifically, with the learning routine, the unsuccessful ignition attempt could consume at least 5 seconds to attempt ignition plus an additional time period of perhaps 5 to 30 seconds to purge the combustion chamber of unburned fuel. Such operation could be confusing and/or frustrating to the user.

SUMMARY OF THE INVENTION

A primary object of this invention is to provide a generally new and improved system for controlling energizing of a silicon nitride igniter wherein the igniter is heated rapidly, within approximately 2 seconds, to ignition temperature.

It is a further object to provide such a system wherein the igniter is energized so as to attain ignition temperature and remain below the maximum allowable temperature in each burner cycle without requiring the occurrence of an unsuccessful ignition attempt.

In accordance with the invention, a system is provided for applying power to an electrical resistance igniter for energizing the igniter to ignition temperature within approximately 2 seconds and for maintaining the igniter at ignition temperature for an additional time period while preventing the igniter from attaining a temperature which could damage the igniter. The system includes a microcomputer which determines the level of power to be applied to the igniter based on the value of the voltage available to energize the igniter and on the value of the resistance of the igniter. A triac in series with the igniter is fired in an irregular firing sequence which causes the level of power to the igniter to be time-varying. In a first embodiment, the firing sequence is determined from a look-up table in the ROM of the microcomputer. In a second embodiment, the firing sequence is determined by a comparison of the igniter temperature, as it is being heated, with a predetermined varying temperature setpoint.

The above mentioned and other objects and features of the present invention will become apparent from the following description when read in conjunction with the accompanying drawings.

DESCRIPTION OF THE EMBODIMENTS

Figure 1:
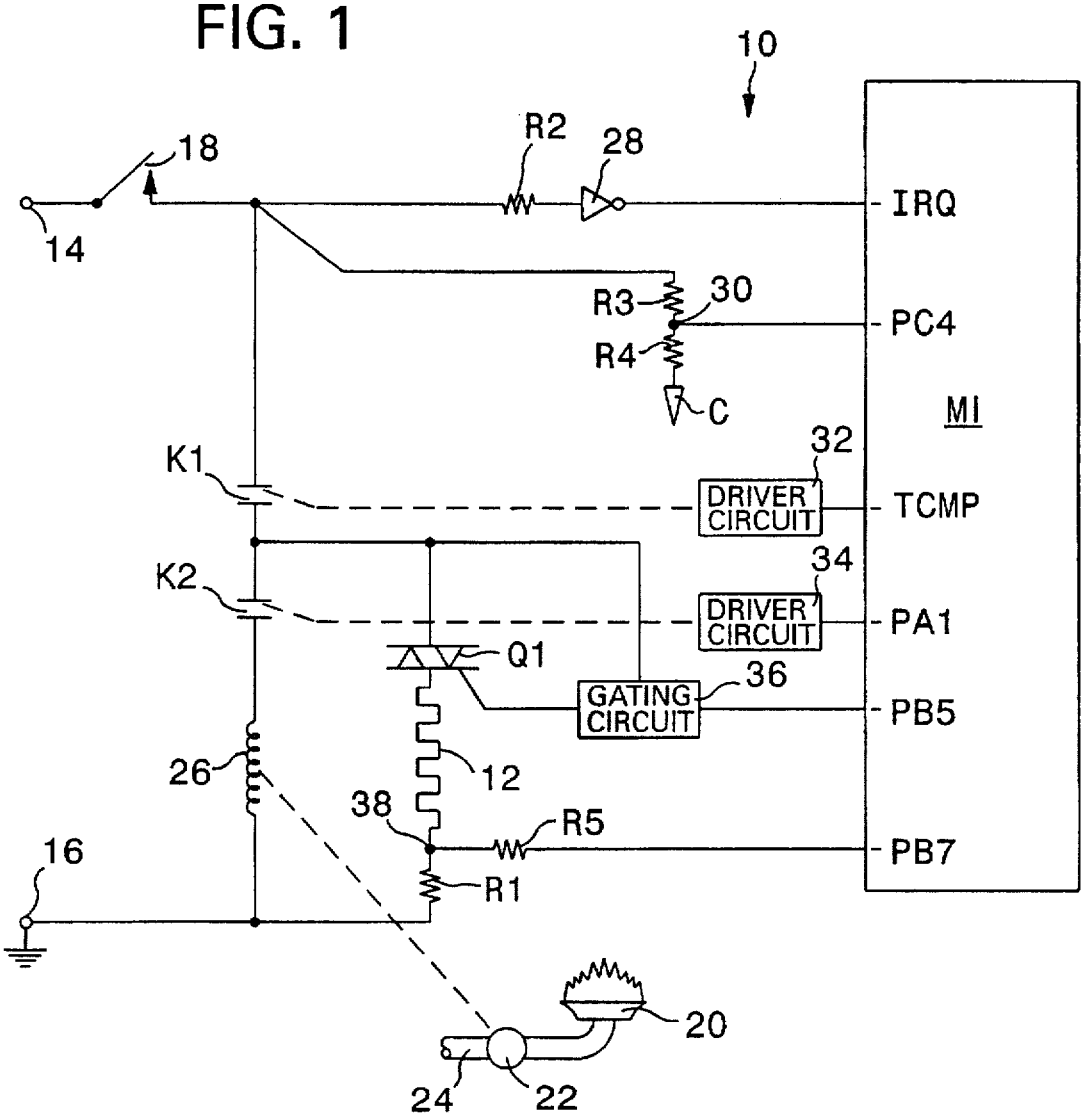
FIG. 1 is a diagrammatic illustration of a system, constructed in accordance with the present invention, for controlling energizing of an electrical resistance igniter.

Referring to FIG. 1, shown therein is a system 10 for controlling energizing of a silicon nitride igniter 12. System 10 is connected to terminals 14 and 16 of a conventional 240 volt alternating current power source.

Igniter 12 is connected at one end to terminal 14 through a triac Q1, a set of normally-open relay contacts K1, and a switch 18, and at the other end to terminal 16 through a 1 ohm resistor R1. Switch 18 is a manually-operated switch which is moved to an ON position whenever operation of control system 10 is desired.

Igniter 12 is effective, when sufficiently heated, to ignite gas emitted from a burner 20. The flow of gas to burner 20 is controlled by a valve 22 in a gas conduit 24 leading from a gas source (not shown) to burner 20. A valve winding 26, which controls valve 22, is connected at one end to terminal 14 through a set of normally-open contacts K2, contacts K1, and switch 18, and at the other end to terminal 16.

A microcomputer M1 is effective for controlling operation of control system 10. Preferably, microcomputer M1 is a Motorola MC68HC705P6 device. Included within microcomputer M1 are a CPU (central processing unit), a ROM (read only memory), a RAM (random access read/write memory), and a plurality of I/O (input/output) pins. Such I/O pins include pins designated IRQ, PC4, TCMP, PA1, PB5 and PB7.

Pin IRQ of microcomputer M1 is connected through an inverter 28, a 1M resistor R2 and switch 18 to terminal 14. Pin IRQ functions as an input pin to enable microcomputer M1 to detect zero crossover of the alternating current power source.

Pin PC4 is connected to a junction 30 between resistors R3 and R4. Resistor R3, approximately 1M ohms, is connected through switch 18 to terminal 14. Resistor R4, approximately 10.5K ohms, is connected to chassis common C. Pin PC4 functions as an input pin to an A/D converter in microcomputer M1 to enable microcomputer M1 to measure the line voltage value existing across terminals 14 and 16.

Pins TCMP, PA1 and PB5 of microcomputer M1 function as output pins to enable microcomputer M1 to control relay contacts K1, relay contacts K2 and triac Q1, respectively. Specifically, Pin TCMP is connected to a driver circuit 32 which includes a relay coil for controlling relay contacts K1. Pin PA1 is connected to a driver circuit 34 which includes a relay coil for controlling relay contacts K2. Pin PB5 is connected to a gating circuit 36 for controlling triac Q1.

Pin PB7 is connected through a 100K ohm resistor R5 to a junction 38 between igniter 12 and resistor R1. Pin PB7 functions as an input pin to an A/D converter in microcomputer M1 to enable microcomputer M1 to measure the voltage across resistor R1.

It is to be understood that microcomputer M1 has a plurality of other pins (not shown) which are connected to other circuitry (not shown) in control system 10. However, a description of such other pins and other circuitry is not believed to be essential to provide an enabling disclosure of the present invention and is therefore omitted.

Operation of control system 10 is controlled by a set of instructions programmed into the ROM of microcomputer M1. A portion of such instructions relating to a first embodiment of the present invention is shown in the flow chart of FIG. 2.

Figure 2:
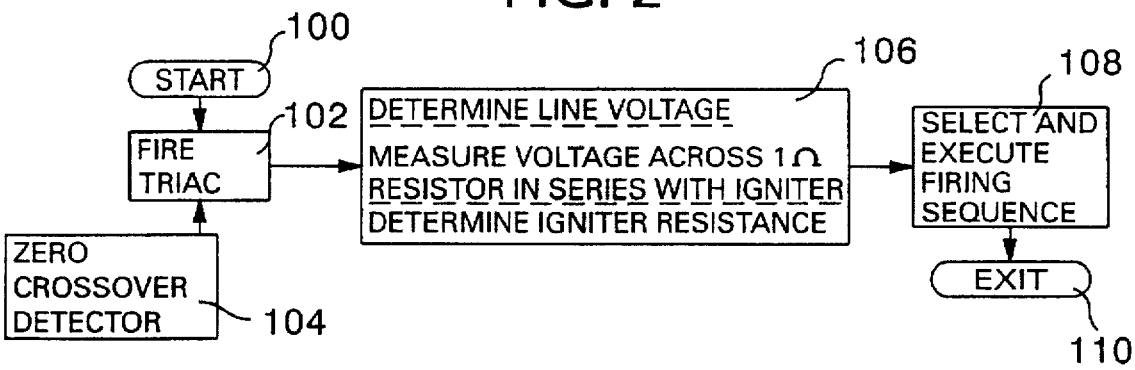
FIG. 2 is a flow chart depicting a first embodiment of a logic sequence programmed into and executed by the microcomputer of the system of FIG. 1.

Referring to FIG. 2, the routine is started in logic step 100 when switch 18 is moved to an ON position, indicating a demand for operation of system 10, and microcomputer M1 provides an enabling output at pin TCMP to driver circuit 32 to cause relay contacts K1 to close. In logic step 102, microcomputer M1 provides an enabling output at pin PB5 to gating circuit 36 to fire (turn on) triac Q1. In logic step 104, microcomputer M1 detects, at pin IRQ and through inverter 28, the zero crossover of the alternating current power source so as to enable firing triac Q1 in step 102 at a desired time in the sine wave of the power source.

In logic step 106, microcomputer M1, at pin PC4, measures the voltage at junction 30 and determines therefrom the value of the line voltage across terminals 14 and 16. Also, microcomputer M1, at pin PB7, measures the voltage at junction 38 which is the voltage across resistor R1. Microcomputer M1 then determines the resistance of igniter 12. Specifically, the resistance of igniter 12 is equal to E/I where E is the voltage across igniter 12 which is essentially equal to the determined line voltage across terminals 14 and 16 minus the measured voltage across resistor R1, and I is the current through igniter 12 which is equal to the measured voltage across resistor R1 divided by the known value of resistor R1. This determined resistance value is referred to as the "cold" resistance.

In the next logic step 108, a firing sequence for triac Q1 is selected from a look-up table in the ROM of microcomputer M1 and executed, as will be described in reference to FIGS. 3 and 4. After the firing sequence is executed, the routine of FIG. 2 exits in logic step 110.

Due to manufacturing tolerances, the "cold" resistance of the igniters can vary considerably from igniter to igniter. Since power is equal to voltage squared divided by resistance, the power (heat) generated by the igniters can thus vary considerably at a given applied voltage. For example, at a given applied voltage, an igniter with a relatively high "cold" resistance will have less current flow, generate less power, and therefore heat up slower and reach a lower temperature than an igniter with a relatively low "cold" resistance. To enable system 10 to provide similar temperature versus time performance for all igniters within specified manufacturing tolerances, such tolerances are compensated for.

Figure 3:
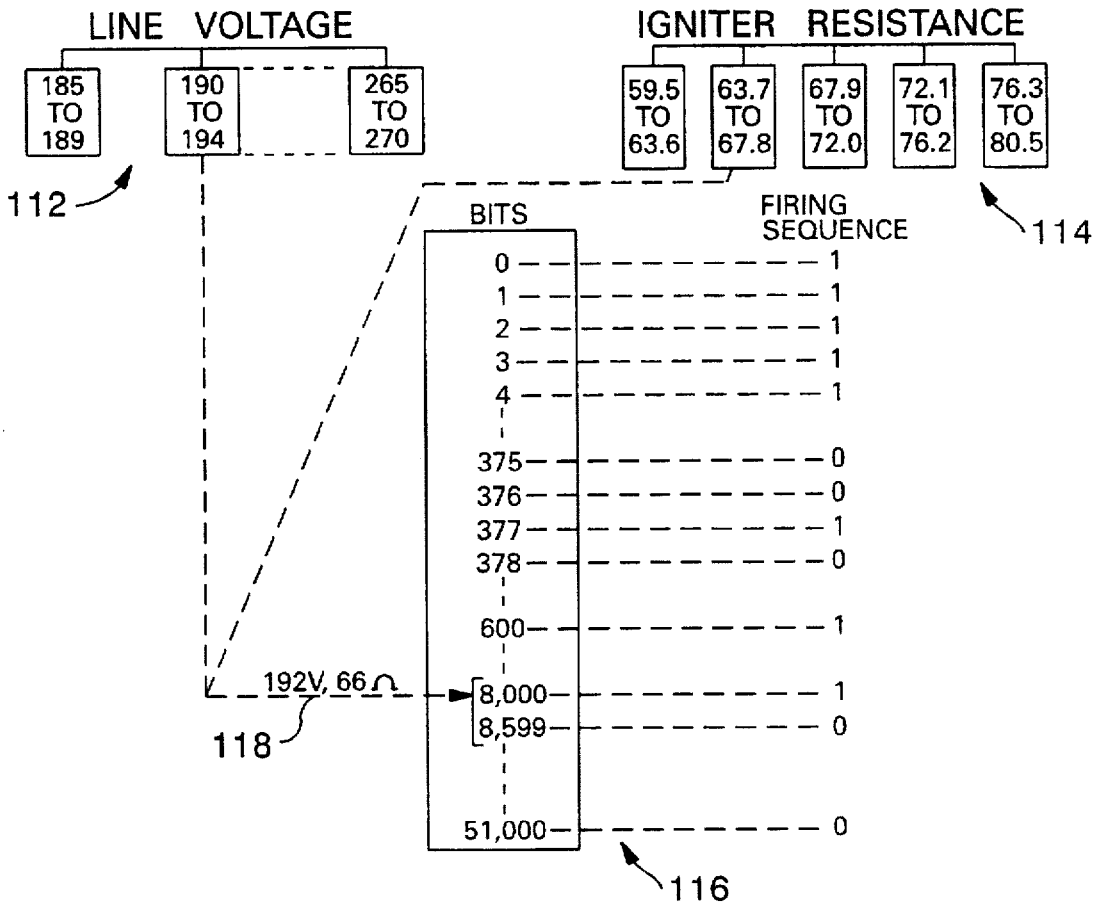
FIG. 3 illustrates a look-up table for selecting the firing sequence to be used in the logic sequence of FIG. 2.

Specifically, referring to FIG. 3, the look-up table provided in the ROM of microcomputer M1 enables selecting a firing sequence for triac Q1 based on the determined value of line voltage and the determined "cold" resistance value of igniter 12. More specifically, the look-up table includes 17 blocks, only 3 of which are shown generally at 112, of voltage values covering the tolerance in line voltage and 5 blocks, shown generally at 114, of resistance values covering the tolerance in the "cold" resistance of igniters that may be used in control system 10. For each pairing of line voltage blocks 112 with igniter resistance blocks 114, there is a designated span of 600 bits in a bit table 116 which defines the firing sequence to be used for triac Q1. For example, as shown at 118 in FIG. 3, a line voltage of 192 volts and an igniter "cold" resistance of 66 ohms designates the bit span of 8000 through 8599 which defines a unique firing sequence. Providing a quantity of 600 bits in each span of bits enables controlling the firing of triac Q1 in each half-cycle of a 60 cycle power source for a time period of 5 seconds.

Typically, gas valve 22 is opened to allow gas to flow to burner 20 when triac Q1 is initially fired. The selected firing sequence is effective to cause igniter 12 to be heated to approximately 1200° C. in approximately 2 seconds. Since ignition temperature is approximately 1100° C., igniter 12 should ignite the gas at burner 20 within the 2 second period.

The selected firing sequence is effective to maintain the temperature of igniter 12 at 1200° C. for approximately 3 additional seconds. If ignition has not occurred at the end of the 3 additional seconds, gas valve 22 is closed and triac Q1 is turned off.

Figure 4:
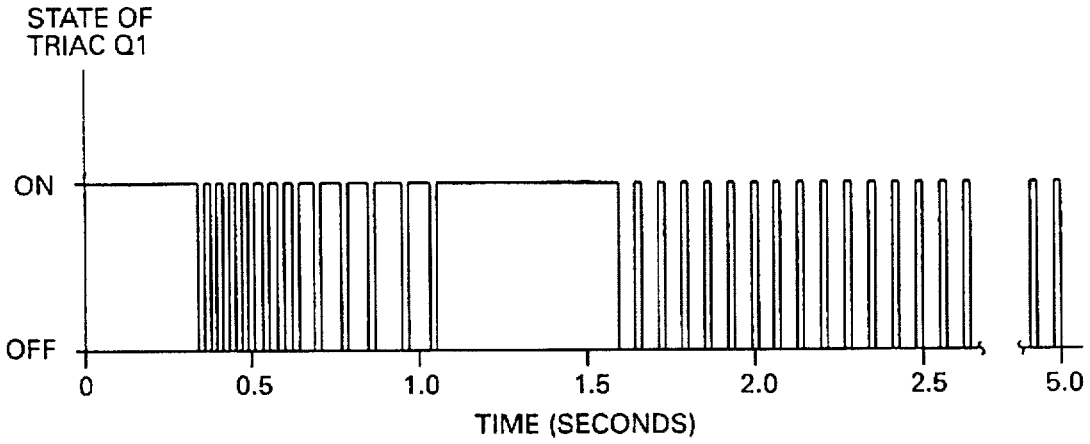
FIG. 4 is a graph illustrating a typical firing sequence selected in FIG. 3.

While each of the 600 bit sequences selected in table 116 differ from each other, they all define a generally irregular pattern of firing of triac Q1 such as the pattern illustrated in FIG. 4. As illustrated therein, triac Q1 is typically turned on a considerable portion of the time in the time period up to 2 seconds and a lesser portion of the time in the time period between 2 seconds and 5 seconds. Such an irregular firing pattern results in the application of time-varying power to igniter 12. Such time-varying power enables igniter 12 to attain ignition temperature within 2 seconds, to remain at ignition temperature for several more seconds, and to do so without exceeding a temperature which could damage it, while taking into account various characteristics of igniter 12. For example, while the gas is ignited by the external surface of igniter 12, it is the internal tungsten heater element that is electrically energized. It takes some period of time for the tungsten heater element to heat up. It also takes some period of time for the heat from the tungsten heater element to transfer to the silicon nitride surface. The time-varying power takes into account these inherent delays.

Figure 5:
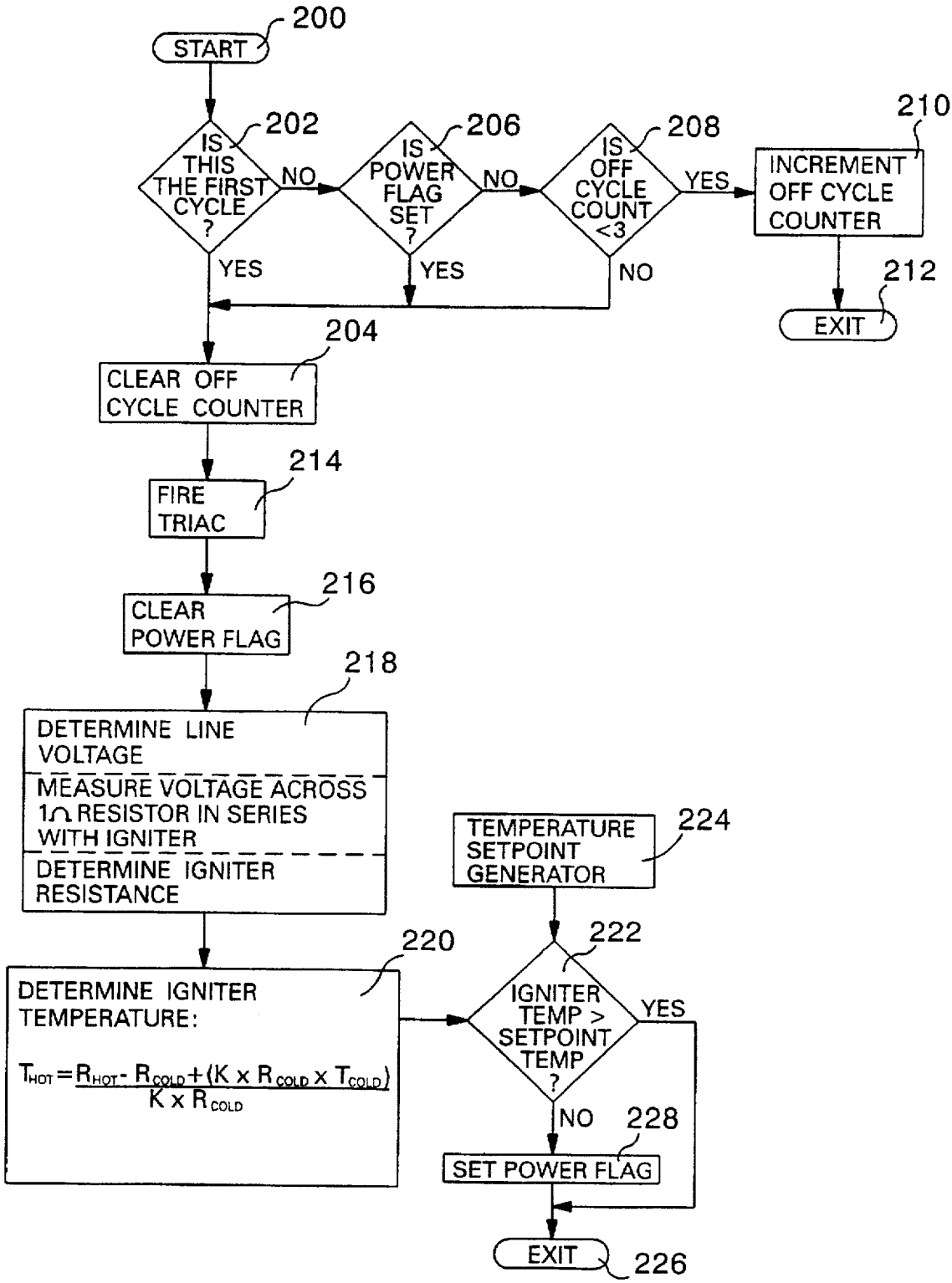
FIG. 5 is a flow chart depicting a second embodiment of a logic sequence programmed into and executed by the microcomputer of the system of FIG. 1.

A second embodiment of the present invention is shown in the flow chart of FIG. 5. The routine therein is started in logic step 200 when switch 18 is moved to its ON position. The first logic inquiry 202 is whether the instant cycle is the first cycle, a cycle being a complete sine wave of the alternating current power source. If the answer to inquiry 202 is yes, an off cycle counter is cleared in logic step 204. If the answer to logic inquiry 202 is no, the logic proceeds to an inquiry 206 as to whether a power flag is set. If yes, the logic proceeds to step 204. If the answer to logic inquiry 206 is no, the logic proceeds to logic inquiry 208 as to whether an off cycle count is less than 3. If the answer to logic inquiry 208 is no, the logic proceeds to step 204. If the answer to logic inquiry 208 is yes, the logic proceeds to step 210 wherein the off cycle counter is incremented. After logic step 210, the routine exits at logic step 212.

After logic step 204, the logic proceeds to logic step 214 wherein triac Q1 is fired. Triac Q1 is fired during both half-cycles of the sine wave. The logic then proceeds to logic step 216 wherein the power flag is cleared. After logic step 216, the logic proceeds to logic step 218.

In logic step 218, line voltage is determined, voltage across resistor R1 is measured, and the resistance of igniter 12 is determined in the same manner as described for logic step 106 in FIG. 2 except that, in logic step 218, the resistance of igniter 12 is determined every time that triac Q1 is fired rather than just once as in logic step 106. The resistance value of igniter 12 determined during the first cycle is referred to as the "cold" resistance, and the resistance value determined during any subsequent cycle is referred to as the "hot" resistance.

After logic step 218, the logic proceeds to logic step 220 wherein the temperature of igniter 12 is determined in accordance with the equation $$T_{hot} = \frac{R_{hot} - R_{cold} + (K \times R_{cold} \times T_{cold})}{K \times R_{cold}}$$

where $T_{hot}$ is the instant temperature of igniter 12 as it is being heated, $T_{cold}$ is a predetermined value, such as 25° C., which is used as the temperature of igniter 12 prior to igniter 12 being energized, $R_{hot}$ is the instant "hot" resistance of igniter 12 as it is being heated, $R_{cold}$ is the "cold" resistance of igniter 12 determined in the first cycle, and K is the temperature coefficient constant of igniter 12.

After logic step 220, the logic proceeds to logic inquiry 222 as to whether the igniter temperature is greater than a setpoint temperature. The igniter temperature involved here is the $T_{hot}$ value from logic step 220, and the setpoint temperature involved is a temperature setpoint obtained from logic step 224. If the answer to logic inquiry 222 is yes, the logic exits at step 226. If the answer to logic inquiry 222 is no, the power flag is set in logic step 228 and then the logic exits at step 226.

Figure 6:
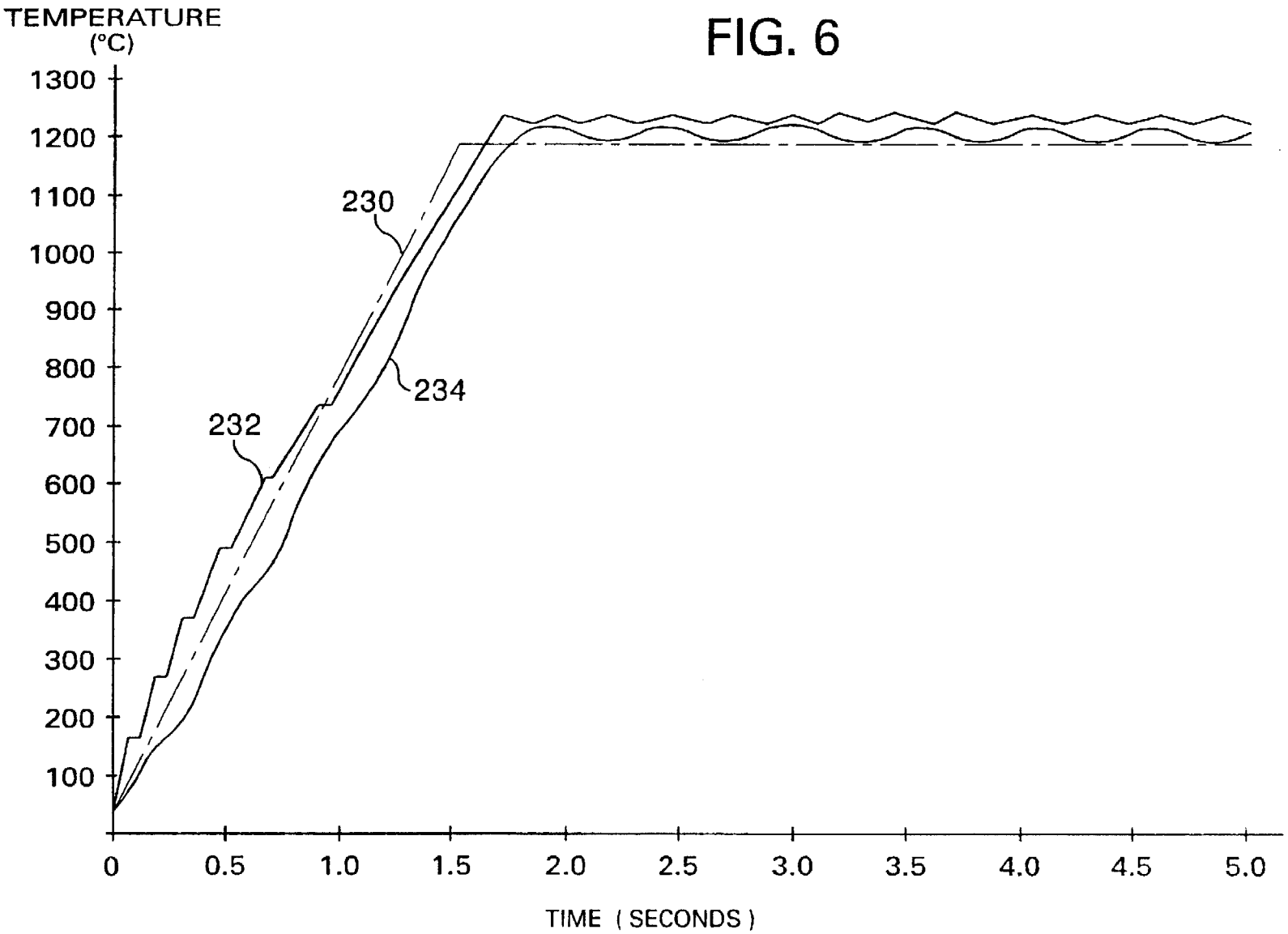
FIG. 6 is a graph illustrating temperature versus time characteristics of the igniter when the igniter is controlled by the logic sequence of FIG. 5.

Referring to FIG. 6, indicated by curve 230 is the temperature setpoint curve generated in logic step 224. As shown therein, curve 230 is a straight line between approximately 25° C. at 0 seconds and 1200° C. at 1.5 seconds, and then is constant at 1200° C. from 1.5 seconds to 5 seconds. Also shown in FIG. 6 are curves 232 and 234 indicating the internal and external temperatures, respectively, of igniter 12. As igniter 12 is being heated to the ignition temperature value, the internal heater element portion of igniter 12 heats up and transfers the heat to the external portion thereof. Thus, the temperature of the external portion (curve 234) of igniter 12 lags the internal temperature (curve 232) by some amount. The amount of the temperature lag decreases after approximately 2 seconds when igniter 12 begins to be energized at a level which maintains igniter 12 at the ignition temperature. It is to be noted that the values of the factors $T_{hot}$, $T_{cold}$, $R_{hot}$, $R_{cold}$ and K in the above equation relate to the internal heater element portion, not to the external portion, of igniter 12.

The second embodiment provides for firing triac Q1 as much as every line cycle when the igniter temperature is not greater than the setpoint temperature, and as little as every fourth line cycle when the igniter temperature is greater than the setpoint temperature. It is noted that firing triac Q1 at least every fourth line cycle enables a determination of the "hot" resistance of igniter 12 at least every fourth line cycle. As in the first embodiment, the result of such an irregular firing pattern is the application of time-varying power to igniter 12 which enables igniter 12 to attain ignition temperature within 2 seconds and to do so without exceeding a temperature which could damage it.

While the invention has been illustrated and described in detail in the drawings and foregoing description, it will be recognized that many changes and modifications will occur to those skilled in the art. It is therefore intended, by the appended claims, to cover any such changes and modifications as fall within the true spirit and scope of the invention.

I claim:

1. In a system for controlling energizing of an electrical resistance igniter, switching means connecting the igniter across a power source; and control means for determining the voltage value of said power source, for determining the resistance value of said igniter, and for determining the level of power to be applied to said igniter by said power source through said switching means based on said voltage and resistance values so as to cause said igniter to be heated to a specified temperature value in a specified time.

2. The system claimed in claim 1 wherein said specified temperature value is approximately 1200° C. and said specified time is approximately 2 seconds.

3. The system claimed in claim 1 wherein said switching means comprises a triac, said control means includes a microcomputer, said microcomputer determines said resistance value of said igniter when said igniter is initially energized thereby establishing a cold resistance value, and wherein said microcomputer includes means for selecting a firing sequence for said triac based on said voltage and said cold resistance values.

4. The system claimed in claim 3 wherein said means for selecting a firing sequence comprises a look-up table in the ROM of said microcomputer.

5. In a system for controlling energizing of an electrical resistance igniter, switching means connecting the igniter across a power source; and control means for periodically determining the temperature value of said igniter as said igniter is being heated, for generating a varying temperature setpoint, for comparing said periodically determined igniter temperature with said varying temperature setpoint, and for operating said switching means based on said comparison so as to cause said igniter to be heated by said power source to a specified temperature value in a specified time.

6. The system claimed in claim 5 wherein said igniter is constructed of a tungsten heater element embedded in a silicon nitride insulating material.

7. The system claimed in claim 5 wherein said specified temperature value is approximately 1200° C. and said specified time is approximately 2 seconds.

8. A method of controlling energizing of an electrical resistance igniter, the method comprising:

determining the voltage value of a power source effective for energizing the igniter;

determining the resistance value of said igniter; and applying power from said power source to said igniter based on said values of voltage and resistance for effecting heating of said igniter to a specified temperature value in a specified time.

* * * * *